US008413857B2

(12) United States Patent
Johnson

(10) Patent No.: US 8,413,857 B2
(45) Date of Patent: Apr. 9, 2013

(54) DUCKBILL FLIP CAP FITMENT FOR A COLLAPSIBLE CONTAINER

(75) Inventor: James W. Johnson, Delaware, OH (US)

(73) Assignee: Liqui-Box Corporation, Worthington, OH (US)

( * ) Notice: Subject to any disclaimer, the term of this patent is extended or adjusted under 35 U.S.C. 154(b) by 572 days.

(21) Appl. No.: 12/683,865

(22) Filed: Jan. 7, 2010

(65) Prior Publication Data

US 2010/0176152 A1 Jul. 15, 2010

Related U.S. Application Data

(60) Provisional application No. 61/143,622, filed on Jan. 9, 2009, provisional application No. 61/162,883, filed on Mar. 24, 2009, provisional application No. 61/166,065, filed on Apr. 2, 2009.

(51) Int. Cl.
*F16K 15/14* (2006.01)

(52) U.S. Cl.
USPC ..... 222/501; 222/92; 222/105; 222/493; 222/494; 383/906

(58) Field of Classification Search ..... 222/81, 222/83, 83.5, 92, 105, 107, 490–494, 499, 222/501, 542, 566, 567, 570, 571, 573; 137/798, 137/846, 847; 383/906; 141/329, 330
See application file for complete search history.

(56) References Cited

U.S. PATENT DOCUMENTS

| | | | | |
|---|---|---|---|---|
| 4,436,125 | A | 3/1984 | Blenkush | |
| RE32,354 | E * | 2/1987 | Savage | 222/81 |
| 5,010,925 | A | 4/1991 | Atkinson | |
| 5,755,269 | A * | 5/1998 | Venooker et al. | 141/292 |
| 8,070,014 | B2 * | 12/2011 | Wisniewski | 222/83 |
| 2004/0251278 | A1 * | 12/2004 | Arai | 222/212 |
| 2005/0211730 | A1 | 9/2005 | Smith | |
| 2007/0131725 | A1 | 6/2007 | Friedman | |
| 2007/0267451 | A1 * | 11/2007 | Robinson | 222/546 |

FOREIGN PATENT DOCUMENTS

| | | | |
|---|---|---|---|
| WO | WO9839589 | A1 | 9/1998 |
| WO | WO2008025145 | A1 | 3/2008 |

OTHER PUBLICATIONS

The International Search Report and Written Opinion of the International Searching Authority, Application No. PCT/US2010/020351, Mailed Mar. 11, 2010.

* cited by examiner

*Primary Examiner* — J. Casimer Jacyna
(74) *Attorney, Agent, or Firm* — Potter Anderson Corroon LLP; Rakesh H. Mehta, Esq.

(57) ABSTRACT

Disclosed herein is a fitment for use with a collapsible bag for dispensing liquids or semi-solids comprising a spout having a generally cylindrical body attached to a collapsible bag, a cap attached to the spout having positioned therein a flexible cap duckbill that allows for the flow of fluid when engaged with a probe assembly.

15 Claims, 4 Drawing Sheets

FLIP LID
EXPLODED ASSEMBLY

DUCKBILL FLIP CAP FITMENT FOR A COLLAPSIBLE CONTAINER

CROSS-REFERENCE TO RELATED APPLICATION

This application claims the benefit of U.S. Provisional Application Ser. No. 61/143,622 filed on Jan. 9, 2009; U.S. Provisional Application Ser. No. 61/162,883 filed on Mar. 24, 2009; and U.S. Provisional Application Ser. No. 61/166,065 filed on Apr. 2, 2009. All these provisional application are hereby incorporated by references in their entirety.

FIELD OF THE INVENTION

The present disclosure relates to a fitment for use with a collapsible container for dispensing liquids or semi-solids from the collapsible container. More particularly, the present disclosure relates to a fitment comprising a duckbill flip cap for use on a collapsible container for dispensing liquids and semi-solids from the container.

BACKGROUND OF THE INVENTION

Many systems are used for dispensing liquids or semi-solids from a disposable package consisting of a flexible collapsible bag in a corrugated box. Such a package is commonly referred to as a bag-in-box dispensing package. Generally, these systems include a bag that is provided with a fitment in the form of a spout through which filling and dispensing occur. It is generally desirable to provide a quick-disconnect coupling between the spout and the service line of the pump or other type of beverage mixing and dispensing system.

However, these closures often employ complicated sealing structures to provide an adequate seal that prevents a product spill. In the past, elastomeric check-valves and O-ring seals have been employed. Furthermore, these closure valves are not cost effective, as multiple parts are required for assembly.

Typically, these fluid couplings use connection types that include an insert and/or cap connected with a fluid source, such as, a bag or bag-in-box. The insert is coupled with a connector or coupler body that can access a fluid dispensing system, such as, a fluid line. Many times, such connectors employ a piercing member at one end so as to puncture a membrane seal disposed on the insert when the connector is mated with the insert for fluid dispensing. Further, such connectors used to mate with the insert on the fluid source are produced so as to be reusable.

There is also a need for coupling valve assemblies which can be reused with a variety of connections. The present invention provides a non-disposable coupling valve assembly that can be utilized with a variety of fluid conduit adaptors.

Disposable containers are routinely used in commercial and industrial applications to transport and dispense a variety of liquids or fluids, such as, food products, cleaning solutions, detergents, and other products. Some containers are constructed of semi-rigid plastic while others are constructed of flexible plastic and are often supported within a protective box.

It is common for such containers to be equipped with valve structures that facilitate dispensing fluids to or from the containers. The valve structures are preferably designed to quickly couple with exterior coupling members.

The female coupling includes a releasable locking or quick-connecting/disconnecting mechanism for locking the male and female couplings together in a coupled state. U.S. Pat. No. 4,436,125 discloses a quick-connect/disconnect coupling assembly. A female coupling member includes a poppet valve assembly that functions as an automatic shut-off of the fluid passageway in the female coupling member when the female coupling member is not interconnected to the male coupling member.

SUMMARY OF THE INVENTION

One aspect of the present invention is fitment for use on a collapsible bag for dispensing of liquids and semi-solids from the bag, the fitment comprising:

(a) a spout comprising a generally hollow cylindrical body having an external surface capable of mating with a cap, the spout having at one end a base portion for securing the spout to the collapsible bag;

(b) a cap having an outer collar and an inner collar with the outer collar and inner collar each having an inner and outer surface, the inner surface of the outer collar and the outer surface of the inner collar forming a cavity adapted to be removably attachable to the spout, cap further comprising a hollow cylinder section comprising a proximal end and a distal end with each having an inner and outer surface, the cylinder section being fixedly attached at its distal end to the inner collar, the inner surface of the inner collar and the outer surface of the proximal end of the cylinder forming a cavity for attachment of a cap duckbill, the cap optionally comprising a flange fixedly attached to the outer surface of the outer collar;

(c) a slidably removable probe; and (d) a substantially hollow cap duckbill adapted to mate with the cavity formed by the outer surface of the proximal end and the inner surface of the inner collar forms a seal within the fitment that can be unsealed by insertion of the probe into the fitment through the hollow cylinder of the cap, the cap duckbill having a tapered end and an ejection end, the tapered end having a reversibly sealable slit capable of preventing fluid flow through the cap upon removal of the probe from the fitment.

Other objects and advantages will become apparent to those skilled in the art upon reference to the detailed description that hereinafter follows.

DETAILED DESCRIPTION OF THE INVENTION

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

DEFINITIONS

In the context of this disclosure, a number of terms shall be utilized.

As used herein, the term "about" or "approximately" means within 20%, preferably within 10%, and more preferably within 5% of a given value or range.

The term "comprising" is intended to include embodiments encompassed by the terms "consisting essentially of" and "consisting of". Similarly, the term "consisting essentially of" is intended to include embodiments encompassed by the term "consisting of":

Fitment

The fitment of the present invention is attached to a liquid container, which usually is a flexible bag of a plastic material or a semi-rigid container, also of a plastic material, that holds liquids or semi-solids that are to be dispensed. The fitment can be tailored to the size of the bag or container so that a desired level of flow can be achieved. A wide variety of liquids or semi-solids can be dispensed using the fitment, such as liquid foods, for example, coffee, soda, milk, cooking oil, or liquid chemicals of various types, such as, detergents, cleaning liquids, hand soap, pastes, glue.

Figure 1:
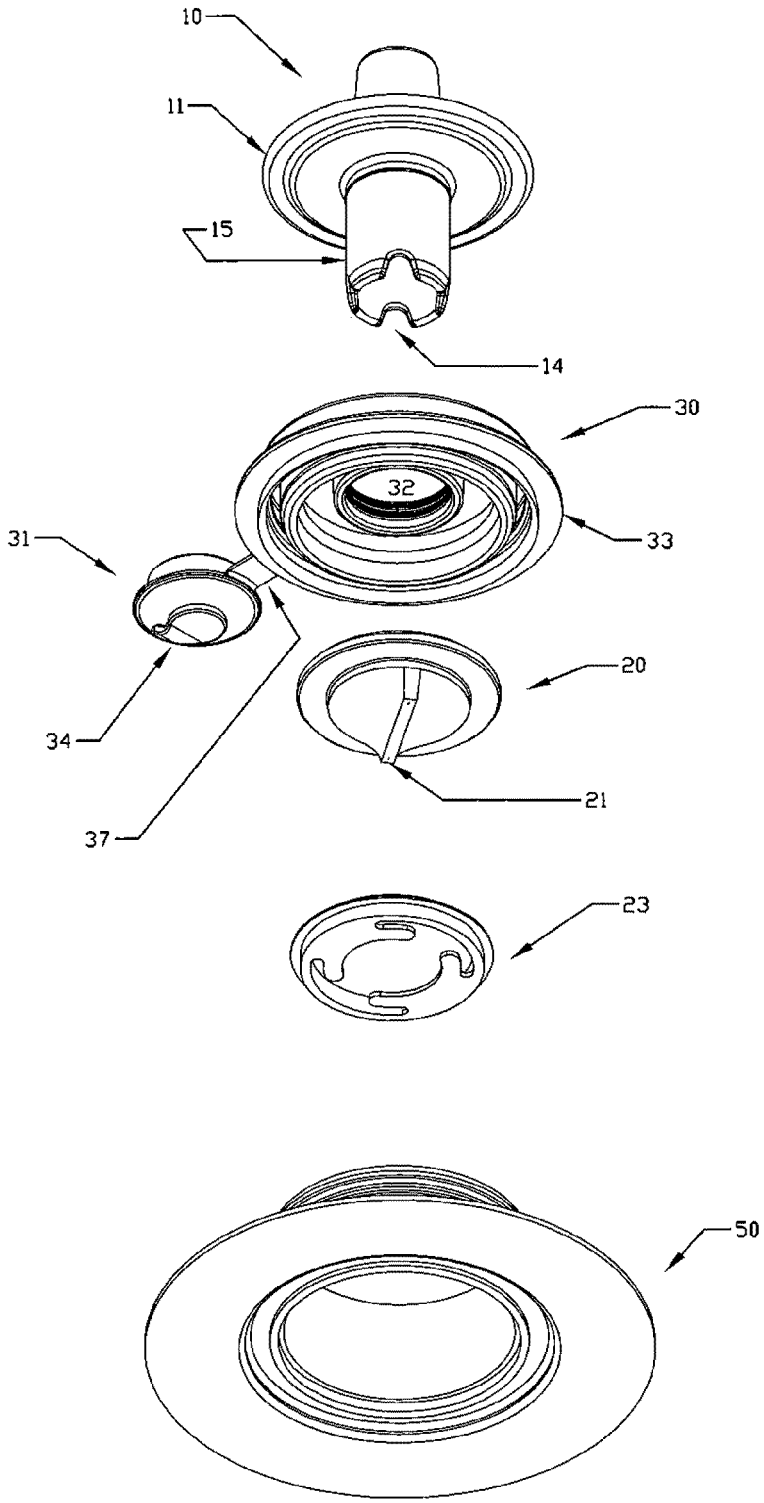
FIG. 1 is a bottom view of an exploded assembly of the of the fitment.

FIG. 1 shows an exploded bottom view of the fitment assembly of this invention. A probe 10 is fitted into flip cap 30 having a flip lid 31 with a pull tab 34. Cap duckbill 20 is positioned in the bottom of the flip cap 30. A duckbill lock ring 23 is positioned between the cap duckbill 20 and the spout 50. Upon engagement of the cap duckbill 20 with the duckbill lock ring 23 and the spout 50, the duckbill lock ring 23 locks into cap 30 and holds the duckbill product flow opening 21 in the cap duckbill 20, closed, and prevents seepage or leakage of liquid that is to be dispensed from the bag or container (not shown) to which spout 50 is attached. Extended periods of holding the liquid container at cold temperatures can cause distortion of the cap duckbill 20 thereby allowing liquid to seep through the flow opening 21. The use of the duckbill locking ring 23 prevents such seepage.

Probe 10 through which material from the bag or container is dispensed, typically is a molded thermoplastic material usually a polyolefin, such as, polyethylene, copolymers and terpolymers of polyethylene, polypropylene, copolymers and terpolymers of polypropylene, polybutylene and copolymers and terpolymers thereof, fluorocarbon polymers and copolymers thereof, polyvinyl chloride and copolymers thereof, polyvinylidene chloride and fluorocarbon polymers and copolymers thereof. Thermosetting polymers such as epoxy resins, phenolic resins, melamine resins can also be used for dispersing some substances. Preferably, polyethylene, polypropylene and copolymers and terpolymers thereof are used for most applications.

Figure 2:
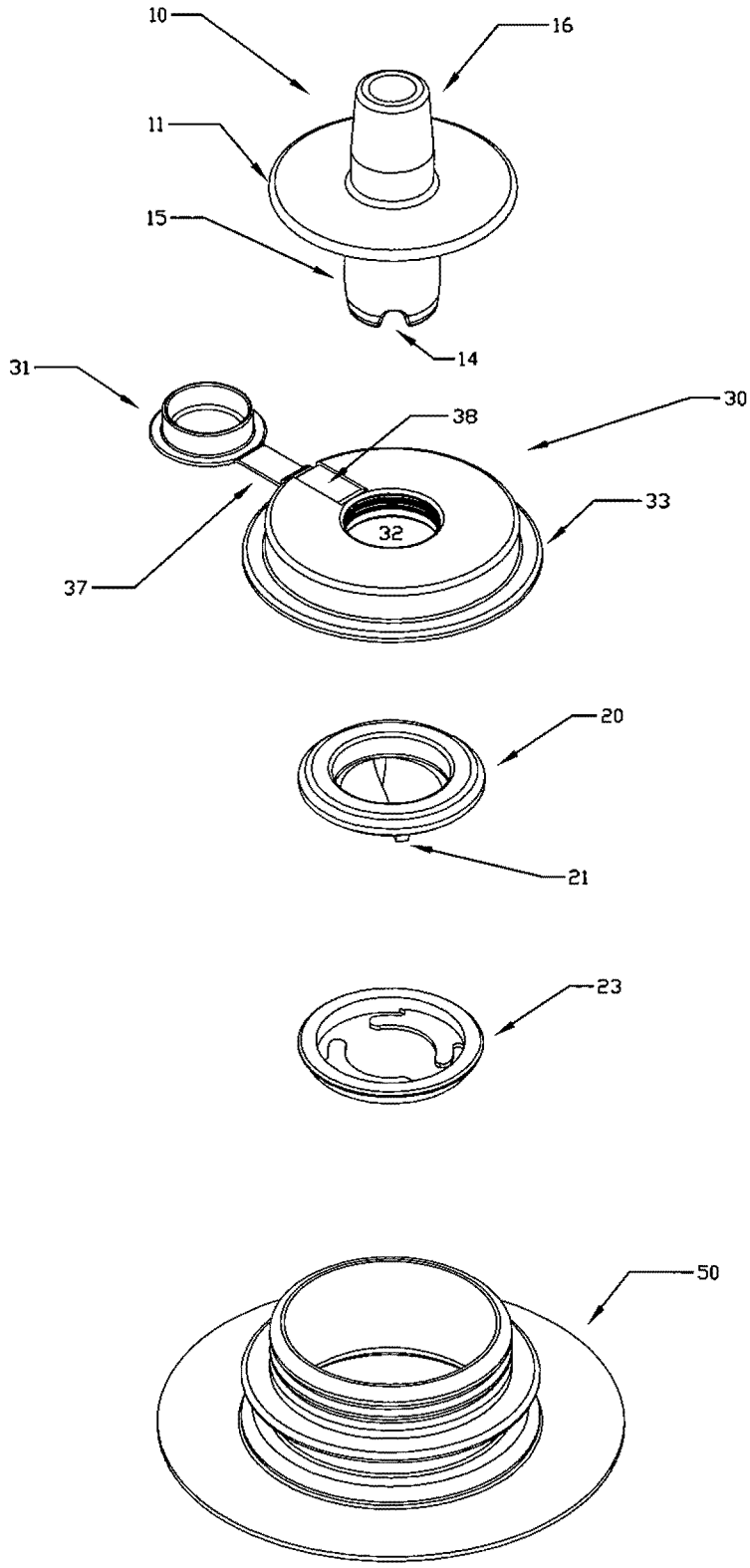
FIG. 2 is a top view of an exploded assembly of the fitment.

FIG. 2 shows a top view of an exploded assembly of the fitment of this invention. Probe 10 is fitted into the inner circular opening 32 of cap 30 having flip lid 31 attached thereto by hinge 37. Hinge 37 fits into the recessed area 38 of cap 30 allowing flip lid 31 to recess into the inner circular opening 32 of cap 30 thereby providing a level and even surface to the top of cap 30 when flip lid 31 is in a closed position. Duckbill lock ring 23 is positioned between cap duckbill 20 and the top of spout 50 and locks into cap 30.

Figure 3:
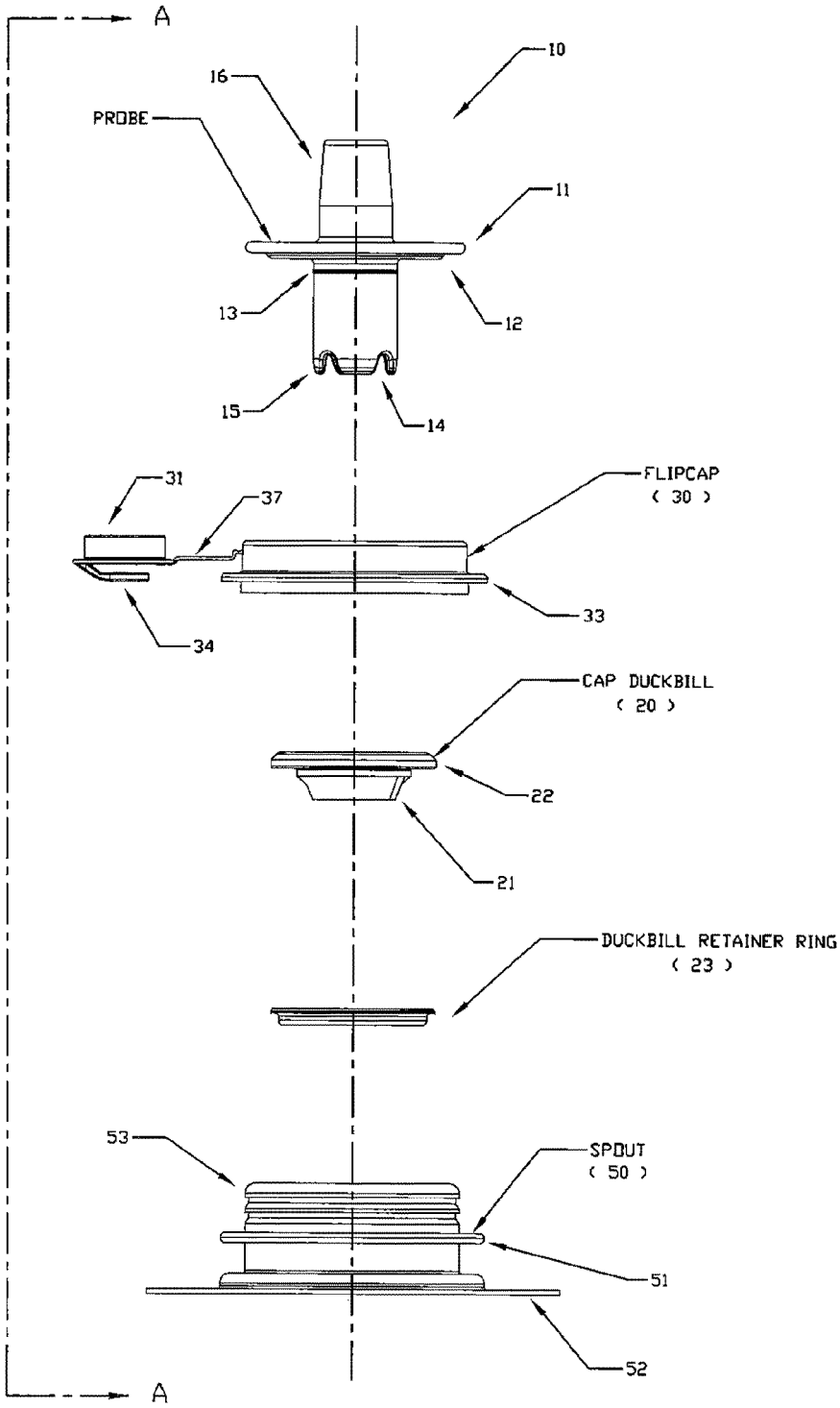
FIG. 3 is a side view of an exploded assembly of the fitment.

FIG. 3 shows a side view of an exploded assembly of the fitment of FIG. 1. The probe 10, which typically is a molded plastic part, has a nozzle 16 and a flange 11 molded to the nozzle 16 that presses against the cap 30. The flange 11 is reinforced with a flange-strengthening rib 12. A locking bead 13 is molded to flange strengthening rib 12 of the probe 10. The locking bead 13 of the probe 10 is attached to the cap 30 and forms a seal with the cap 30. Probe lead-in 15, preferably having at least two more, and preferably four, product flow slots 14 through which product flows from bag, engages and forms a seal with the inner circular opening 32 of the flip cap 30. (Also see FIG. 1 and FIG. 2). The probe lead-in 15 need not have these product flow slots 14 and still be operative and allow for flow of fluid from the bag or container.

The total length of the probe 10 is about 1 to 2 inches, typically 1.4 inches, and the nozzle 16 of the probe 10 is about 0.75 inches. The outer diameter of the nozzle 16 of the probe is about 0.5 inches. The diameter of the flange 11 that presses against the cap 30 depends on the width of the cap but typically is about 1.325 inches. Typically, the thickness of the wall of the probe 10 is about 0.095 inch in the nozzle section and about 0.05 inch at the seal at the edge of the flange 11. The above dimensions can vary depending on the liquid being dispensed.

The inner diameter of the nozzle 16 of the probe 10 is about 0.25 inch and a variety of hoses typically can be attached to the nozzle 16. Typically, the hoses are attached to the nozzle 16 by a friction fit of the hose to the nozzle; however, other methods also can be used, such as, a hose clamp or the exterior of the nozzle may be provided with ribs or with a roughened surface for a better friction fit.

The cap duckbill 20 is a molded elastomeric product or a soft flexible plastic material having a duckbill product flow opening 21. (See FIG. 1 also.) The bottom of the probe 10 is fitted into duck bill seal 22 and engages with the inner wall of the nozzle 16. The duckbill product flow opening 21 (illustrated in FIG. 1 in a closed position) of the cap duckbill 20 typically is a re-closable opening, such as a slit in the cap duckbill 20 that allows fluid to flow from the bag or container upon engagement of the probe 10 by application of a downward force applied to the duckbill 20. As pointed out above, the duckbill lock ring 23 prevents seepage of liquid through the product flow opening 21 until there is engagement by the probe 10. The product flow opening 21 of the cap duckbill 20 can be molded in such a manner that it would be broken open on engagement of probe 10. In the alternative, the product flow opening 21 can be sealed with a thin layer of material that is broken on engagement of the probe 10, or the opening itself can be sealed but breakable on engagement of the probe 10 and then re-sealable when the probe is disengaged. The duckbill seal 22 fits into cap 30 and forms a seal with inner circular opening 36 of the flip cap 30. (See FIG. 4 also.) Optionally, the duckbill seal 22 can be permanently attached to the flip cap 30 by welding or heat sealing it to the cap 30.

The primary advantage of the use of the cap duckbill 20 is to prevent back flow from the bag or container through the cap 30 when the probe 10 is not engaged and the hose attached to the probe 10 is removed. The cap duckbill shape as shown in FIG. 1 is preferred but other shapes can be used that would provide the same function. Typically, the length of the cap duckbill 20 is from about 0.375 to 1.000 inch and the width about 0.3 inch, but these dimensions may vary depending on the design of the fitment.

The cap duckbill 20 is molded from an elastomeric material or a soft flexible plastic material that can withstand the effects of the fluid being dispensed. Typically useful elastomers are styrene/butadiene copolymers, butyl rubbers, polysulfide rubbers, polyisoprene, ethylene-propylene terpolymers (EPDM rubber), silicone rubbers, polyurethane rubbers, and the like. A soft flexible plastic material can also be used such a linear low molecular weight polyethylene or copolymers and blends thereof. The duckbill lock ring 23 also can be molded from any of the above materials, preferably, a plastic material, such as high density polyethylene or high density polypropylene.

The flip cap 30 is a molded plastic part preferably formed of polyethylene but any of the aforementioned thermoplastics can be used. The flip cap 30 has attached to it a flip lid 31 by hinge 37 which can be moved and engaged with the opening of the flip cap 32 and forms a seal to retain liquid in the bag or container when the probe 10 is not inserted into or when it is removed from the opening of the flip cap 32. Also, a seal of a thin film of plastic, coated paper, metal foil and the like can be sealed over the opening 32 of the flip cap to keep liquid product in the container or bag fresh and prevent spoilage. This seal can readily be removed, broken, or punctured at the time when product is to be removed from the container or bag. A pull tab 34 is molded to the flip lid 31 for easy opening and closing of the flip lid 31. The flip cap 30 has a handling flange 33 for holding the cap 30 while it is being moved over the spout 50 or removed there-from. The interior of the cap 30 fits over the sealing bead(s) 53 of the spout 50 to form liquid tight seal with the spout 50. The spout 50 also has a sealing flange 52 molded thereto and forms a liquid tight seal with the bag or container (not shown) when attached there-to.

The flip lid 31 of the flip cap 30 is an optional feature and can be eliminated in particular when a seal is positioned over the opening 32 of the cap 30 and when the fitment is used only for an initial installation and the bag or container is not subsequently removed or closed after disengagement of the probe 10.

Another optional feature is that the hinge 37 of the flip lid 31 can be recessed into a slot or recessed area 38 in the flip cap 30 to form a even surface on the on the flip lid 30. The recessed area 38 in the flip cap 30 is of a sufficient depth so that the flip lid 31 and the pull tab 34 are also recessed in the flip cap 30.

Figure 4:
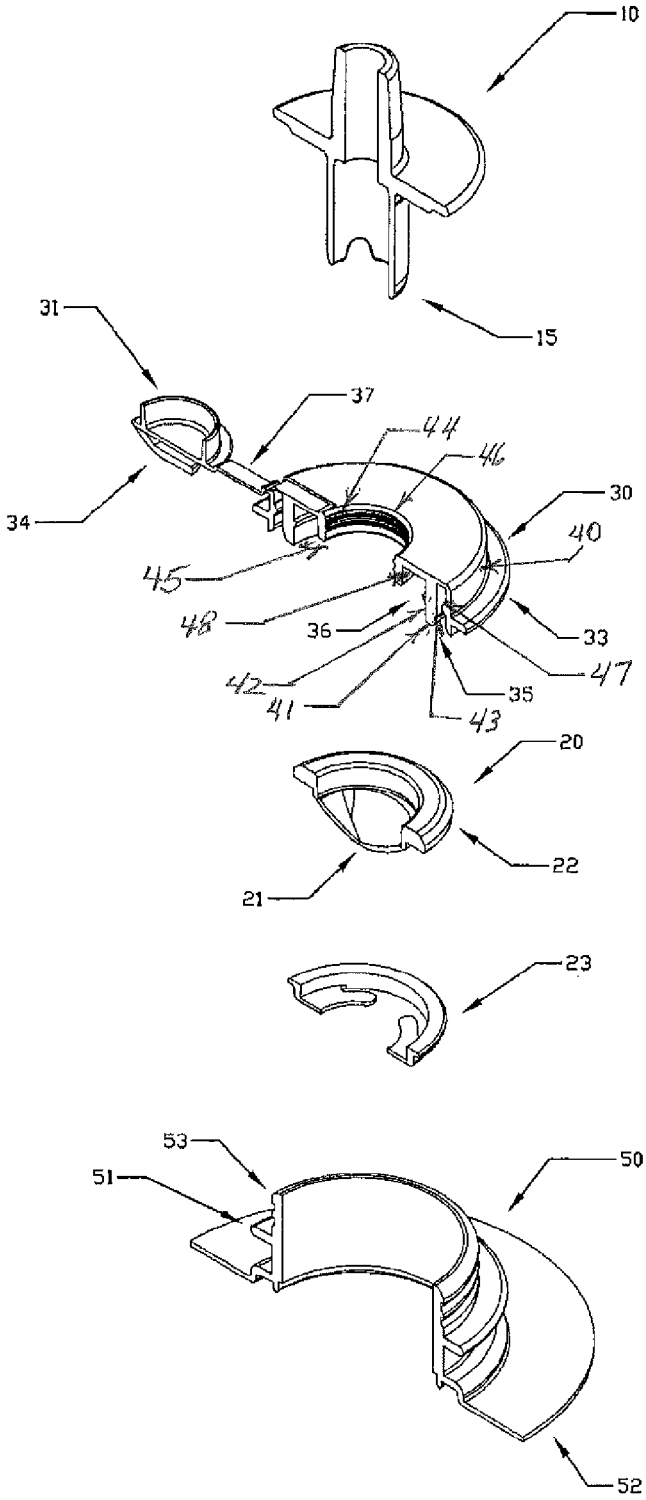
FIG. 4 is a cross sectional view of the assembly of the fitment taken at line A-A of FIG. 3.

FIG. 4, which is a cross sectional view of the assembly of the fitment (taken at line A-A' in FIG. 3) shows the positioning of the cap duckbill 20 in the flip cap 30 and the flip cap onto the spout 50. The cap 30 has an outer collar 40 and an inner collar 41 with the outer collar and inner collar each having an inner and outer surface. The inner surface 47 of the outer collar 40 and the outer surface 43 of the inner collar 41 form a cavity 35 (also called U shaped collar opening below) adapted to be removably attachable to the spout 50. The cap 30 further comprising a hollow cylinder section 44 comprising a proximal end 45 and a distal end 46 with each having an inner and outer surface, the cylinder section being fixedly attached at its distal end 46 to the inner collar 41. The inner surface 42 of the inner collar 41 and the outer surface 48 of the proximal end 45 of the cylinder forming a cavity 36 (also called U shaped collar opening below) for attachment of cap duckbill 20. The cap 30 optionally has a flange 33 fixedly attached to the outer surface of the outer collar 40. The flip cap 30 has two U-shaped collar openings: 35, which is the outer opening, and 36, which is the inner opening. The duckbill seal 22 of the cap duckbill 20 fits into the U-shaped collar opening 36 for inner opening) of the cap duckbill 20 and forms a seal. When the probe lead-in 15 of the probe 10 engages with the cap duckbill 20, the flow opening 21 of the cap duckbill 20 is forced open and fluid is allowed to flow. Similarly, when the probe 10 is disengaged, the flow opening 21 closes and seals and prevents further flow of any fluid from the bag. Duckbill lock ring 23 holds the flow opening 21 of the cap duckbill 20 closed until the probe 10 engages the cap duckbill 20 to allow flow of liquid and the top ring of the duckbill lock ring 23 fits into the inner opening 36 of the flip cap 30 and forms a seal with the flip cap 30.

As illustrated in the FIG. 4, the flip cap 30 fits over the spout 50. The proximal end of the spout 50 fits into the outer U-shaped collar opening 35 of the flip cap 30 and a seal is formed with the spout seal beads 53 of the spout 50.

Spout 50 is attached to a bag not shown via the molded sealing flange 52. Typically, the sealing flange 52 is heat sealed to the bag or container. The spout 50 has a handling flange 51 for ease of handling the fitment and the bag when attached. The spout 50 is molded from any of the aforementioned thermoplastic materials, although, polyethylene is preferred.

The invention as fully described above may embody other specific forms or variations without departing from its spirit or essential characteristics. In that regard, the embodiments described above are to be considered in all respects as illustrative and not restrictive, the scope of the invention being indicated by the claims rather than by the foregoing description and any and all changes which come within the meaning and range of equivalency of the claims are intended to be embraced therein.

Another embodiment of the fitment of this invention comprises a probe having a generally hollow cylindrical body having a proximal end and a distal end, the distal end forming a nozzle having a nipple capable of mating with a tube, the proximal end having an external surface adapted to mate with the inner surface of the distal end of the cap; the proximal end further having at least one indentation which permits fluid flow through the probe when the dome of the cap seal has been collapsed by the probe, the proximal end and distal end being separated by a flange on the outer surface of the probe which extends around the circumference of the probe; the probe when mated with the cap collapsing the dome of the cap seal thereby removing the seal between the cap and the cap seal to allow fluid flow from the bag through the fitment, and the probe when removed from mating with the cap uncollapsing the dome of cap seal thereby resealing the seal between the cap and the cap seal.

Still another embodiment of the fitment of this invention comprises a substantially hollow probe duckbill adapted to mate with the inner surface of the probe near the proximal end of the probe; the probe duckbill having a tapered end and a receiving end, the tapered end having a reversibly sealable slit capable of preventing backflow of fluid upon removal of the tube from the probe; the receiving end being in fluid communication with the flow from the spout when the seal between the cap and the cap seal has been removed.

A further embodiment of the fitment of this invention comprises a substantially hollow probe duckbill adapted to mate with the inner surface of the probe near the proximal end of the probe; the probe duckbill having a tapered end and a receiving end, the tapered end having a reversibly sealable slit capable of preventing backflow of fluid upon removal of the tube from the probe; the receiving end being in fluid communication with the flow from the spout when the seal between the cap and the cap seal has been removed.

Another embodiment of the fitment of comprises a cap having a flip-top lid joined to the cap by a hinge which allows the flip-top lid to move between a closed position on the cap whereby the hollow cylinder section is covered and an open position away from the hollow cylinder. The cap can have a flip-top lid having a means for locking the flip-top lid in the closed position on the cap.

A still further embodiment of the fitment of this invention comprises using a probe that is a machine probe.

What is claimed is:

1. A fitment for use on a collapsible bag for dispensing of liquids and semi-solids from the bag, the fitment comprising:

(a) a spout comprising a generally hollow cylindrical body having an external surface capable of mating with a cap, the spout having at one end, a base portion for securing the spout to the collapsible bag;

(b) a cap having an outer collar and an inner collar with the outer collar and the inner collar each having an inner and outer surface, the inner surface of the outer collar and the outer surface of the inner collar forming a cavity adapted to be removably attachable to the spout, the cap further comprising a hollow cylinder section comprising a proximal end and a distal end with each having an inner and outer surface, the cylinder section being fixedly attached at its distal end to the inner collar, the inner surface of the inner collar and the outer surface of the proximal end of the cylinder forming a cavity for attachment of a cap duckbill, the cap optionally comprising a flange fixedly attached to the outer surface of the outer collar;

(c) a slidably removable probe; and (d) a substantially hollow cap duckbill adapted to mate with the cavity formed by the outer surface of the proximal end of the cylinder and the inner surface of the inner collar of the cap and which forms a seal within the fitment that is unsealed by insertion of the probe into the fitment through the hollow cylinder of the cap, the cap duckbill having a tapered end and an ejection end, the tapered end having a reversibly sealable slit capable of preventing fluid flow through the cap upon removal of the probe from the fitment.

2. The fitment of claim 1, wherein the probe comprises a generally hollow cylindrical body having a proximal end and a distal end, the distal end forming a nozzle having a nipple capable of mating with a tube, the proximal end having an external surface adapted to mate with the inner surface of the distal end of the cap, the proximal end further having at least one indentation which permits fluid flow through the probe when the dome of the cap seal has been collapsed by the probe, the proximal end and distal end being separated by a flange on the outer surface of the probe which extends around the circumference of the probe, the probe when mated with the cap collapsing the dome of the cap seal thereby removing the seal between the cap and the cap seal to allow fluid flow from the bag through the fitment, and the probe when removed from mating with the cap uncollapsing the dome of cap seal thereby resealing the seal between the cap and the cap seal.

3. The fitment of claim 1, further comprising a substantially hollow probe duckbill adapted to mate with the inner surface of the probe near the proximal end of the probe, the probe duckbill having a tapered end and a receiving end, the tapered end having a reversibly sealable slit capable of preventing backflow of fluid upon removal of the tube from the probe, the receiving end being in fluid communication with the flow from the spout when the seal between the cap and the cap seal has been removed.

4. The fitment of claim 2, further comprising a substantially hollow probe duckbill adapted to mate with the inner surface of the probe near the proximal end of the probe, the probe duckbill having a tapered end and a receiving end, the tapered end having a reversibly sealable slit capable of preventing backflow of fluid upon removal of the tube from the probe, the receiving end being in fluid communication with the flow from the spout when the seal between the cap and the cap seal has been removed.

5. The fitment of claim 1, wherein the cap further comprises a flip-top lid joined to the cap by a hinge which allows the flip-top lid to move between a closed position on the cap whereby the hollow cylinder section is covered and an open position away from the hollow cylinder.

6. The fitment of claim 5, wherein the cap and the flip-top lid have a means for locking the flip-top lid in the closed position on the cap.

7. The fitment of claim 1, wherein the cap further comprises a removable or breakable seal which covers the distal end of the cap.

8. The fitment of claim 7, wherein the breakable seal is broken by the first insertion of the probe into the cylinder of the cap.

9. The fitment of claim 7, wherein the seal comprises a thin material selected from the group consisting of plastic, paper or metal foil.

10. The fitment of claim 1, wherein the probe is a machine probe.

11. The fitment of claim 1 wherein the cap duckbill is firmly attached to the inner surface of the collar of the cap.

12. The fitment of claim 11 wherein the cap duckbill is attached by being welded or heat sealed to the collar of the cap.

13. The fitment of claim 1 wherein the reversibly sealable slit of the duckbill is sealed closed and when punctured by the probe is opened and then reseals on removal of the probe.

14. The fitment of claim 5 wherein the hinge of the flip-top lid is recessed into the cap and thereby allowing the flip-top lid to be recessed into the cavity in the cap.

15. The fitment of claim 1 having a duckbill lock ring in engagement with the cap duckbill to prevent flow of liquid from the bag until the probe engages the cap duckbill.

* * * * *